United States Patent [19]

Wallace

[11] Patent Number: 4,858,534

[45] Date of Patent: Aug. 22, 1989

[54] BALLISTIC LUBRICATING AND PROCESS

[75] Inventor: William G. Wallace, Aurora, Ill.

[73] Assignee: Amoco Corporation, Chicago, Ill.

[21] Appl. No.: 154,654

[22] Filed: Feb. 10, 1988

Related U.S. Application Data

[62] Division of Ser. No. 855,128, Apr. 23, 1986, Pat. No. 4,735,146.

[51] Int. Cl.[4] ..... F42B 11/20; F42B 31/02

[52] U.S. Cl. ..... 102/511; 42/76.02; 86/19; 89/1.25; 102/435; 252/11; 252/17; 252/21; 252/25; 252/28; 252/30; 252/32; 252/49.6; 427/238; 427/239

[58] Field of Search ..... 102/511, 293, 430, 435; 86/17, 19; 252/25, 9, 11, 12, 17, 23, 28, 49.6, 32, 49, 29, 30, 18; 558/289, 292; 42/76.02, 106; 89/1.25, 14.05, 1.1

[56] References Cited

U.S. PATENT DOCUMENTS

| | | | |
|---|---|---|---|
| 802,301 | 10/1905 | Michele | 102/430 |
| 3,356,029 | 12/1967 | Seidel | 102/511 |
| 3,911,820 | 10/1975 | Canon | 102/511 |
| 3,940,339 | 2/1976 | Clarke, Jr. et al. | 252/18 |
| 3,972,286 | 8/1976 | Canon | 102/511 |
| 4,100,080 | 7/1978 | Adams | 252/18 |
| 4,100,081 | 7/1978 | Dreher | 252/25 |
| 4,155,858 | 5/1979 | Adams | 252/25 |
| 4,513,668 | 4/1985 | Fuller | 102/511 |
| 4,582,617 | 4/1986 | Doner | 252/49.6 |
| 4,587,026 | 5/1986 | Horodysky | 252/49.6 |

*Primary Examiner*—Howard J. Locker

*Attorney, Agent, or Firm*—Thomas W. Tolpin; William H. Magidson; Ralph C. Medhurst

[57] ABSTRACT

A high performance ballistic grease is used in ammunition and a lubricating process to protect the barrel of a weapon from corrosion and overheating. The ballistic grease, ammunition, and process improve the structural integrity and accuracy of the weapon and are economical, nontoxic, effective, and safe. The preferred ballistic lubricating grease comprises a polyalphaolefin base oil, an amorphous silicon dioxide thickener, and a disodium octaborate tetrahydrate additive.

2 Claims, 1 Drawing Sheet

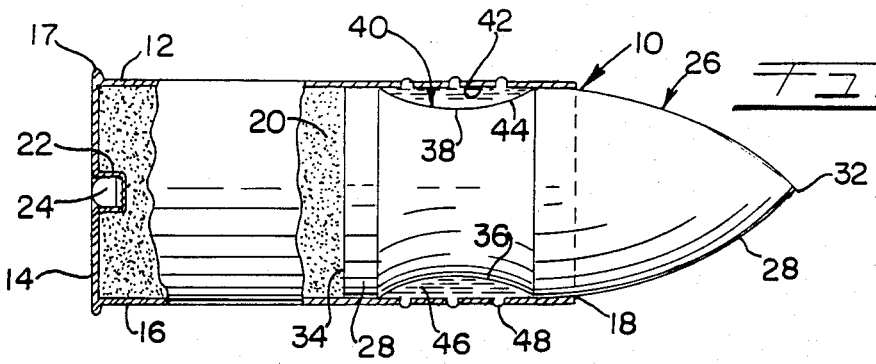
FIG. 1
FIG. 2
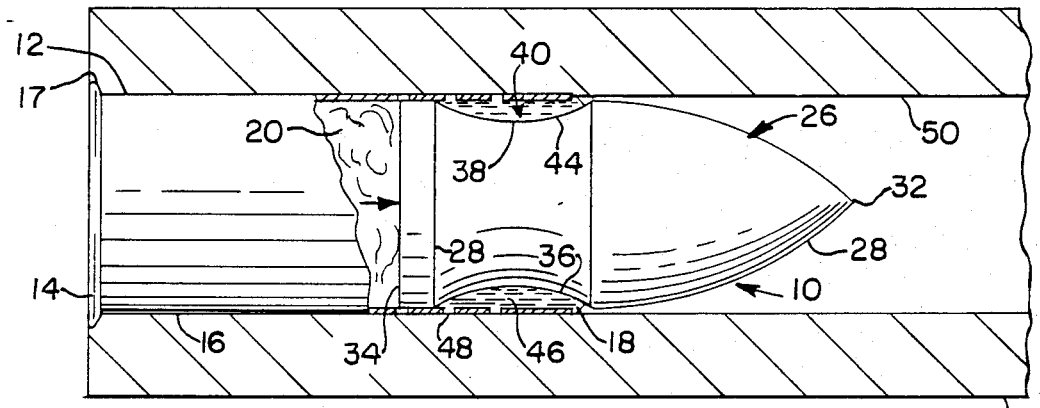
FIG. 3
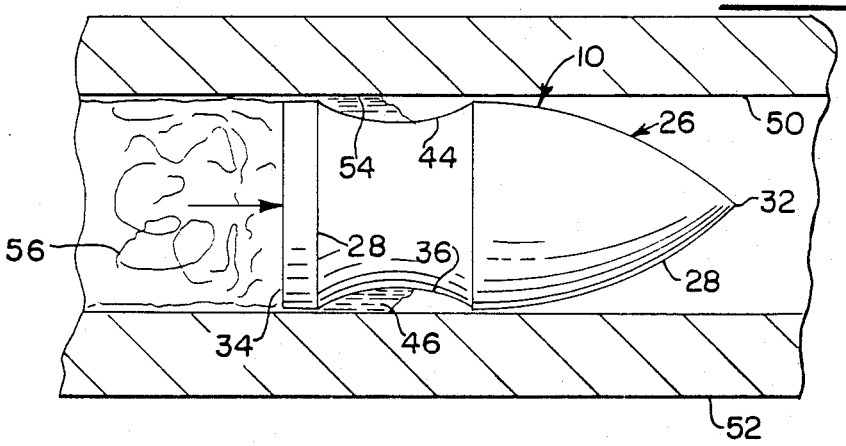
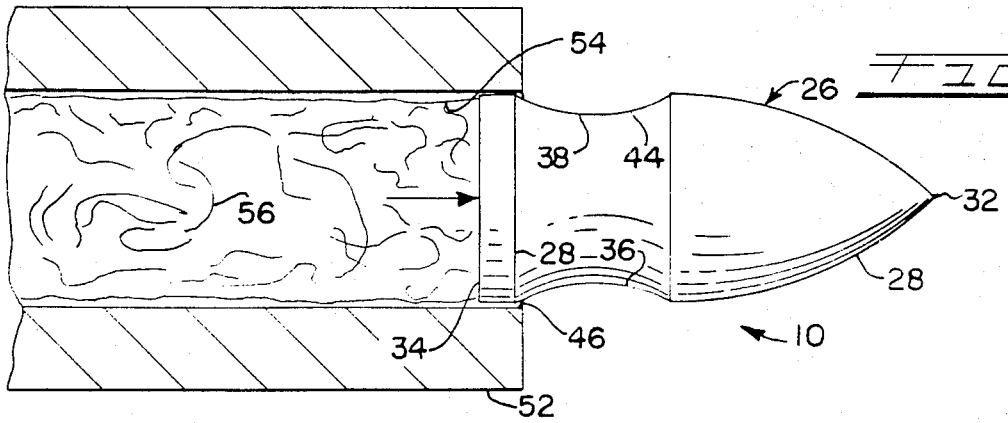
FIG. 4

BALLISTIC LUBRICATING AND PROCESS

This is a division of application Ser. No. 855,128, filed Apr. 23, 1986, now U.S. Pat. No 4,735,146, issued Apr. 5, 1988.

BACKGROUND OF THE INVENTION

This invention pertains to ballistics and, more particularly, to a lubricating grease, ammunition, and process for extending the life of a barrel of a weapon.

Throughout history, mankind has developed weapons for hunting and military purposes. Modern weapons fire projectiles, such as bullets, artillery shells, missiles, etc. Various weapons for shooting projectiles include firearms, such as guns and rifles, bazookas, automatic weapons, such as machine guns, semiautomatic rifles, and large caliber weapons such as cannons, howitzers, and rockets. The desirability of a weapon depends upon its size, accuracy, mobility, safety, shooting distance, and impact and penetration characteristics of the projectiles fired from the weapon Firing of projectiles from a weapon causes some dgree of erosion (physical wear) and corrosion (chemical wear) of the barrel of the weapon through which the projectile is shot. The severity of the erosion and corrosion can undesirably widen the bore of the weapon, deform the barrel, and adversely affect the accuracy of the projectile and the safety of surrounding personnel.

Erosion of the barrel is caused by metal to metal contact between the ammunition and the barrel as the projectile is shot out of the weapon. Many weapons use spiraling (rifling) to spin the projectile in order to stabilize its flight. In such weapons, either the projectile, normally the case with small firearms, or the projectile's rotating band, normally the case with larger weapons, are of slightly larger diameter than the land diameter of the barrel. As the projectile is fired, the lands or spiraled rifling ridges in the bore engraves the projectile or its rotating band to impart a rotation as the projectile passes through the barrel. Such rotation enhances the stability, range, and accuracy of the projectile, but causes bore erosion. Bore erosion is particularly severe in high muzzle velocity weapons.

Corrosion of the barrel is typically caused by nitrates, phosphates, or other corrosive gases emitted from the propellant of the ammunition upon firing the projectile. These corrosive gases, by reason of their high temperature and velocity, tend to soften, melt, and remove microscopic portions of the gun barrel material from the bore surface of the weapon each time a round is fired. Because of the direct contact between the flow of hot propellant gases and the bore surface, a considerable amount of heat is transferred to the gun barrel with each round fired. Under conditions of sustained rapid fire, the temperature of the barrel of the weapon can increase to a level which may exceed the deformation or melting point of the metal in the weapon and causes the barrel to deform or deflect With a sustained rate of fire which produces a net heat input to the barrel greater than that which can be dissipated, the ammunition chamber can become so hot that it may accidentally and prematurely detonate and misfire rounds of ammunition placed therein which can injure nearby personnel and damage the weapon.

In various weapons and particularly automatic weapons, rapid, repetitive, or high muzzle-velocity firing creates a lot of rapidly expanding hot propellant gases which can overheat the barrel and increase the rate of bore corrosion. Overheated barrels increase the amount and severity of wear. This problem is so acute with machine guns that they are usually built with quick change barrels. A machine gun can easily wear out a dozen or more barrels before the remaining parts of the weapon are worn out. It is not uncommon for barrels to be fired until the heat destroys them. It is apparent that significantly reduced heating and bore wear could significantly improve weapon effectiveness in such circumstances and extend the service life of the weapon.

In large caliber weapons, bore corrosion is less a consequence of direct mechanical interaction of the ammunition with the barrel than of gas corrosion. Hot propellant gases often expand through minor cracks in the barrel surface of large caliber weapons around the projectile. Gas pressures and temperatures can exceed 40,000 psi and 2,000° F. downstream of the projectile, which can be detrimental to the longevity and structural integrity of the barrel.

Over the years, a variety of greases, ammunition, and processes have been developed to decrease bore erosion and corrosion. Typifying such greases, ammunition, and processes, as well as other types of greases, are those found in U.S. Pat. Nos. 34,031, 126,614, 407,890, 440,672, 499,487,587,342, 627,929, 802,301, 819,518, 1,039,774, 1,189,011, 1,191,178, 1,376,316, 1,481,930, 1,678,162, 2,011,249, 2,193,631, 2,360,473, 2,398,695, 3,095,376, 3,097,169, 3,130,671, 3,208,387, 3,313,727, 3,322,020, 3,267,035, 3,356,029, 3,429,261 3,488,721, 3,565,802, 3,580,178, 3,828,678, 3,907,691, 3,942,408, 3,997,454, 4,089,790, 4,100,080, 4,100,081, 4,108,044, 4,155,858, 4,163,729, 4,196,670, 4,203,364, 4,239,006, 4,334,477, 4,353,282, 4,395,934, 4,417,521, 454,175, 4,465,883, and 4,513,668. These greases, ammunition, and processes have met with varying degrees of success.

Many prior art greases tend to agglomerate or discharge grit and sand which aggravates, rather than inhibits, barrel wear. Such prior art greases often contain silicon or mineral oil which produce a residual cloud of sand or ash at the end of the barrel of the weapon. Such sand and ash may injure the operator's eyes if safety goggles are not worn, interfere with the operator's vision of the target, and pollute the atmosphere.

Some prior art greases suffer from the disadvantages of being too costly or too difficult to apply to either the weapon or the ammunition. Furthermore, many prior art greases are unable to withstand the frictional temperatures and pressures encountered in normal weapon firing over sustained periods of time.

It is, therefore, desirable to provide an improved grease, ammunition, and process which overcomes most, if not all, of the above problems.

SUMMARY OF THE INVENTION

An improved ballistic lubricating grease is provided to effectively lubricate and protect the barrel of a weapon and retard erosion and corrosion. The novel grease displayed unexpectedly, surprisingly good results over prior art greases. The new grease provides superior wear protectinn and helps cool the barrel of the weapon. It further resists chemical corrosion, deformation, and degradation and extends the useful life of the weapon.

Desirably, the novel grease protects the environment, minimizes pollution, enhances the safety of surrounding personnel, and substantially prevents emission and discharge of sand and soot from the end of the weapon.

The novel grease performs well at high temperatures and over long periods of time. It exhibits excellent stability, superior wear qualities, and good oil separation properties even at high temperatures. Advantageously, the grease is economical to manufacture and can be produced in large quantities.

The novel ballistic lubricating grease enhances the structural integrity, longevity, and accuracy of the weapon. It is also nontoxic and safe.

To this end the improved ballistic lubricating grease has a substantial portion of a base oil, a thickener, and an additive package that imparts extreme pressure properties to the grease. Desirably, the additive package comprises a sufficient amount of boron to substantially minimize wear and overheating of the barrel of a weapon upon firing of a projectile through the barrel.

The boron additive can comprise a borate of a Group 2a alkaline earth metal, potassium borate, zinc borate, sodium borate, boric oxide, or disodium octaborate tetrahydrate.

The thickener can be fumed silica (amorphous silicon dioxide), polyurea, clay, or lithium, calcium, or aluminum soaps, and complex soaps.

The base oil can comprise naphthenic oil, paraffinic oil, aromatic oil, mineral oil, or a synthetic oil, such as polyalphaolefin, a polyester, or a diester.

For best results, the base oil comprises polyalphaolefin, the thickener comprises fumed silica, and the additive package comprises disodium octaborate tetrahydrate ion A novel process is also described in the application to lubricate and extend the useful life of a barrel of a weapon. In the process, a projectile is shot through a barrel of a weapon. Corrosive gases are emitted from the propellant in the ammunition upon shooting. Advantageously, the barrel is cooled and barrel wear is minimized by coating, covering, and injecting a substantial portion of the barrel with a borate lubricating grease as the projectile is shot through the barrel of the weapon. The coating provides a protective layer and film of lubricating grease on the barrel before a substantial amount of the corrosive gases can contact, attack, and corrode the barrel. The preferred lubricating grease is described above.

Novel ammunition utilizing the improved ballistic lubricating grease is also described in the application to minimize wear and overheating of the barrel of a weapon. The ammunition comprises a shell which provides a casing. The casing has a base and an annular skirt which extends from the base. The skirt has an open end which provides an outlet opening. An explosive propellant is positioned in the shell near the base. A projectile is partly positioned in the shell. The projectile has a rearward portion and a forward portion. The rearward portion of the projectile has a base section which is annularly surrounded by the skirt of the shell. The forward portion of the projectile has a tip which extends forwardly from the skirt of the shell and out of the outlet opening of the casing.

In order to effectively lubricate and protect the barrel of the weapon, the ammunition is constructed with a lubricating chamber near the rearward portion of the projectile. The lubricating chamber contains the improved ballistic lubricating grease described above and has means, such as apertures, holes, rupturable membranes, or pressure-burstable walls, which inject, disperse, and dispense the grease over the barrel of the weapon when the ammunition is fired.

A more detailed explanation of the invention is provided in the following description and the appended claims taken in conjunction with the accompanying drawings.

BRIEF DESCRIPTION OF THE DRAWINGS

FIG. 1 is a cross-sectional view of ammunition containing a ballistic lubricating grease in accordance with of the present invention;

FIG. 2 is cross-sectional view of the ammunition being shot through a barrel of a weapon in accordance with the principles of the present invention;

FIG. 3 is a side view of the projectile after it has separated from its casing; and FIG. 4 is a side view of the projectile being shot out of the end of the barrel of a weapon.

DETAILED DESCRIPTION OF THE PREFERRED EMBODIMENT

A high perrormance ballistic lubricating grease is provided to effectively lubricate and protect the barrel of a weapon from corrosive ballistic gases emitted from a propellant. While the preferred weapon is a large caliber high velocity artillery weapon, such as a howitzer, the ballistic lubricating grease can also be effectively used with other weapons, such as handguns, pistols, rifles, semiautomatic rifles, machine guns and other automatic weapons, bazookas, rocket launchers, cannons and other ordnance and munitions equipment.

The novel ballistic lubricating grease exhibits excellent extreme pressure (EP) properties and antiwear qualities and is economical, nontoxic, and safe. The grease is an excellent lubricant between contacting metals and/or plastics, such as between artillery shells and the barrel of a weapon. The grease provides superior protection against wear caused by ballistic erosion and corrosion It also provides outstanding protection against overheating and chemical attack from corrosive gases emitted from the propellant of the ammunition.

The preferred ballistic lubricating grease comprises by weight: 60% to 85% base oil, 3% to 20% thickener, and 1% to 20% of a borate extreme pressure wear-resistant additive. For best results, the ballistic lubricating grease comprises by weight: at least 75% by weight base oil, 3% to 12% thickener, and 1% to 12% of a borate extreme pressure wear-resistant additive.

INHIBITORS

The additive package may be complemented by the addition of small amounts of an antioxidant and a corrosion-inhibiting agent, as well as dyes ad pigments to impart a desired color to the composition. Antioxidants or oxidation inhibitors prevent varnish and sludge formation and oxidation of metal parts. Typical antioxidants are organic compounds oontaining nitrogen, such as organic amines, sulfides, hydroxy sulfides, phenols, etc., alone or in combination with metals like zinc, tin, or barium, as well as phenyl-alpha-naphthyl amine, bis(alkylphenyl)amine, N,N-diphenyl-p-phenylenediamine, 2,2,4- trimethyldihydroquinoline oligomer, bis(4-isopropylaminophenyl)-ether, N-acyl-p-aminophenol, N-acylphenothiazines, N-hydrocarbyl-amides of ethylenediamine tetraacetic acid, and alkylphenol-formaldehyde amine polycondensates.

Corrosion-inhibiting agents or anticorrodants prevent rusting of iron by water and suppress attack by acidic bodies. A typical corrosion-inhibiting agent is an alkali metal nitrite, such as sodium nitrite. Other ferrous corrosion inhibitors include metal sulfonate salts, alkyl and aryl succinic acids, and alkyl and aryl succinate esters, amides, and other related derivatives.

Metal deactivators can also be added to prevent or diminish copper corrosion and counteract the effects of metal on oxidation by forming catalytically inactive compounds with soluble or insoluble metal ions. Typical metal deactivators include mercaptobenzothiazole, complex organic nitrogen, and amines.

Stabilizers, tackiness agents, dropping-point improvers, lubricating agents, color correctors, and/or odor control agents can also be added to the additive package.

BASE OIL

The base oil can be naphthenic oil, paraffinic oil, aromatic oil, mineral oil, or a synthetic oil, such as polyalphaolefin (PAO), polyester, diester, or combination thereof. The viscosity of the base oil can range from 50 to 10,000 SUS at 100 ° F.

Other hydrocarbon oils can also be used, such as: (a) oil derived from coal products, (b) alkylene polymers, such as polymers of propylene, butylene, etc., (c) alkylene oxide-type polymers, such as alkylene oxide polymers prepared by polymerizing alkylene oxide (e.g., propylene oxide polymers, etc., in the presence of water or alcohols, e.g., ethyl alcohol), (d) carboxylic acid esters, such as those which were prepared by esterifying such carboxylic acids as adipic acid, azelaic acid, suberic acid, sebacic acid, alkenyl succinic acid, fumaric acid, maleic acid, etc., with alcohols such as butyl alcohol, hexyl alcohol, 2-ethylhexyl alcohol, etc., (e) liquid esters of acid of phosphorus, (f) alkyl benzenes, (g) polyphenols such as biphenols and terphenols, (h) alkyl biphenol ethers, and (i) polymers of silicon, such as tetraethyl silicate, tetraisopropyl silicate, tetra(4-methyl-2-tetraethyl) silicate, hexyl4-methol-2-pentoxy) disilicone, poly(methyl)siloxane, and poly(methyl)phenylsiloxane.

The preferred base oil is polyalphaolefin for best results. Polyalphaolefin will not generally decompose into sand and ash when the weapon is fired and, therefore, significantly minimizes emissions of silicon and ash (soot) from the end of the barrel of the weapon which occurs with some prior art greases. Such sand and soot pollute the atmosphere and create a health hazard and visual impediment for the users of the weapon and surrounding personnel. Polyalphaolefin provides a relatively clean, transparent discharge (emission) which is safe, nontoxic, and biodegradable. Polyalphaolefin helps protect the environment.

Polyalphaolefin is a high viscosity fluid. It enhances shear stability. It is effective at high temperatures, such as during shooting of a weapon, as well as low temperatures, such as storage in winter and arctic locations. Polyalphaolefin provides superior oxidation and hydrolytic stability and high film strength. Polyalphaolefin also has a higher molecular weight, higher flash point, higher fire point, lower volatility, higher viscosity index, and a lower pour point than mineral oil.

Polyalphaolefin has a typical molecular structure as follows:

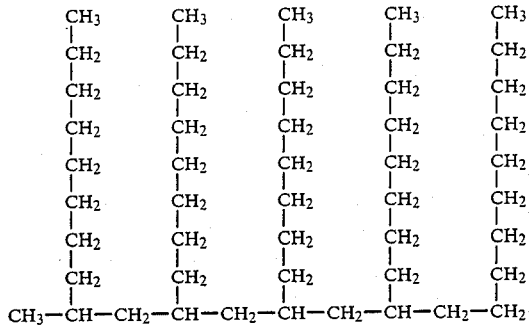

One particularly useful type of polyalphaolefin is sold by Uniroyal, Inc. under the brand name SYNTON PAO-40. SYNTON PAO-40 polyalphaolefin has a viscosity of 188 SUS at 212° F. and 2131 SUS at 104° F. It has a viscosity index of 142 and a pour point of −55° F. It has a molecular weight of 1450,a flash point of 550° F., and a fire point of 650° F.

THICKENER The thickener can be fumed silica, polyurea, including biurea (diurea) and triurea, clay, regular simple soap, or complex soap. The soaps can contain an alkaline material such as lithium, calcium, sodium, or aluminum, or hydroxides thereof. Other thickeners can be used.

The preferred thickener is fumed silica for best results. Fumed silica is amorphous silicon dioxide. It is safe, nontoxic, and effective. It has superb thickening efficiency, is relatively inert, and will not generally decompose into sand or ash when the weapon is fired. Its particle sizes are relatively small but have a large surface area. It is optically transparent and can be of food-grade quality. Fumed silica has the following properties:

| Property | Designation |
|---|---|
| Surface Area ($M^2/g$) | 175–225 |
| pH (4% Aqueous Dispersion) | 3.6–4.3 |
| Density (lbs/cu ft) (as bagged) | 8–12 |
| Wt. % Moisture | 1.5 |
| Silica Content (% Ignited Basis) | 99.8 min. |
| Specific Gravity | 2.2 |
| Refractive Index | 1.46 |
| Color | White |
| X-ray Form | Amorphous |

Fumed silica can be produced by the hydrolysis silicon tetrachloride vapor in a flame of hydrogen and oxygen in accordance with the following reactions:

(1) $2H_2+O_2 \rightarrow 2H_2O$ (2) $SiCl_4+2H_2O \rightarrow SiO_2+4HCl$ (Overall Reaction): 1800° C.

$SiCl_4+2H_2+O_2 \rightarrow SiO_2+4HCl$

When fumed silica is prepared, molten spheres of silica are typically formed. The spheres range in diameter from 7 to 30 millimicrons. The molten spheres provide primary particles which collide and fuse with one another to form branched, three-dimensional, chain-like aggregates. As the aggregates cool below the 1710° C.

fusion temperature of silica, further collisions form some reversible agglomeration.

Thereafter, residual adsorbed hydrogen chloride on the surface of the fumed silica is reduced to less than 200 PPM by calcination.

Fumed silica is nonporous and is capable of hydrogen bonding with suitable molecules of materials in vapor, liquid, or solid form. The moisture adsorption capacities of fumed silica increase with the increasing surface area.

One useful type of fumed silica is sold by Cabot Corporation under the brand name of CAB-0-SIL MS-7SD.

ADDITIVE

In order to attain extreme pressure properties, antiwear qualities and effective protection and lubrication of the barrel of a weapon, the additive in the additive package comprises boron, preferably borate, such as a borate of a Group 2a alkaline earth metal, potassium borate, zinc borate, sodium borate, boric oxide, disodium octaborate tetrahydrate, or combinations thereof.

The preferred borate additive is disodium octaborat tetrahydrate. Disodium octaborate tetrahydrate is safe, nontoxic, and effective. Disodium octaborate tetrahydrate efficiently cools the barrel of a weapon and substantially prevents the barrel of the weapon from overheating upon firing of a projectile or other ammunition through the barrel. Disodium octaborate tetrahydrate provides high performance and superior wear qualities for weapons. It is economical, readily available, and stable. It can be reliably used in different climates and temperatures in summer or winter. It is also used as fire retardants in the treatment of lumber and, therefore, provides additional safety for surrounding personnel as well as environmental protection for nearby trees and plants.

Disodium octaborate tetrahydrate comprises: 14.7% by weight sodium oxide, 67.1% by weight boric oxide, and 18.2% by weight water. Disodium octaborate tetrahydrate has a molecular weight of 412.52 and the following chemical formulation:

$$Na_2B_8O_{13}.\ 4H_2O.$$

Disodium octaborate tetrahydrate readily dissolves in water to give supersaturated solutions of 1.6% to 30% by weight from 32° F. to 200° F. and is substantially better than borax at similar temperatures. At temperatures above 140° F., concentrated disodium octaborate tetrahydrate becomes very viscous and forms a layer of film as the water therein is vaporized to steam.

One useful type of disodium octaborate tetrahydrate is sold by U.S. Borax & Chemical Corporation under the brand name of POLYBOR.

AMMUNITION

High performance ammunition is provided to effectively lubricate and grease the barrel of a weapon, such as an artillery weapon. Advantageously, the ammunition utilizes the ballistic lubricating grease described above. The ammunition has most of the superb qualities and properties discussed previously with respect to the ballistic lubricating grease.

As shown in the Figures of the drawings, the ammunition 10 comprises an artillery shell providing a cylindrical casing or jacket 12. The casing has a circular base 14 and an annular skirt or sleeve 16 which extends from the base of the casing. The outer rim and edge 17 of the base has a larger diameter than the skirt. The skirt has a circular open end 18 which provides an outlet opening at the end of the skirt opposite the base of the casing.

An explosive propellant 20 is positioned within and fills a substantial portion of the interior of the artillery shell adjacent to the base of the casing. The base of the casing has a socket, hole, or opening 22 about its center into which is placed a percussion primer 24 to ignite the explosive propellant when the ammunition is fired.

The ammunition has a wear-reducing projectile 26 with a rearward cylindrical portion 28 and a pointed forward portion 30 having a pointed tip 32. The cylindrical rearward portion of the projectile has a circular base section or base portion 34 which is annularly surrounded by the skirt of the casing. The tip of the projectile extends forwardly of the casing and out of the outlet opening of the artillery shell.

In the illustrative embodiment, the rearward portion of the projectile has a concave annular surface 36 with a central portion 38 which is spaced annularly and radially inwardly of the interior surface of the skirt of the casing. The concave section of the projectile cooperates with the forward portion of the skirt of the casing to provide an annular lubricating chamber or compartment 40 therebetween. The lubricating chamber has a circular exterior 42 and a convex annular interior 44. Positioned within the lubricating chamber is the ballistic lubricating grease 46 described above. The forward portion of the skirt of the casing has a multitude of apertures, lubricating holes, or passageways 48 therein to dispense and disperse the ballistic lubricating grease onto the barrel 50 (FIG. 2) and bore of the weapon 52 when the projectile is shot out of the casing to effectively lubricate, protect, and cover a substantial portion of the barrel or bore of the weapon In some circumstances, it may desirable to use a lubricating chamber having a rupturable wall or thin pressure-collapsible membrane to dispense the ballistic lubricating grease upon the barrel of the weapon when the ammunition is fired or to utilize an annular or other shaped lubricating chamber that is positioned rearwardly of the base of the projectile.

PROCESS

In use, the ballistic lubricating grease and ammunition provide a high performance ballistic lubricating process which extends the life of the barrel of a weapon. The process provides most of the distinct advantages, performance qualities, and characteristics described above for the ballistic lubricating grease and ammunition.

As shown in FIGS. 2–4 of the drawings, when the ammunition is fired, the primer is activated, such as by penetration or striking, which in turn ignites and explodes the propellant in the shell. The explosion of the propellant in the shell causes enormous pressures and rapid expansion of the propellant gases to rapidly propel, push, drive, move, and force the projectile forwardly out of the shell. As this occurs the ballistic lubricating grease in the lubricating chamber is expelled and discharged outwardly through the apertures at the forward end of the casing to lubricate and cover a substantial portion of the barrel of the weapon as shown in FIG. 2.

After the projectile exits the casing, the ballistic lubricating grease is forced and injected annularly outwardly and rearwardly of the projectile by the momentum and force of the projectile to cover most of the barrel forwardly of the artillery shell (casing) as shown in FIGS. 3 and 4. The lubricating grease provides a protective film-like layer and barrier 54 (FIG. 3) of ballistic lubricating grease about the bore and barrel of the weapon before the ballistic propellant corrosive gases 56 emitted from the propellant upon ignition and firing of the ammunition can contact, chemically attack, and corrode the barrel.

The protective layer of ballistic lubricating grease cools, lubricates, and minimizes wear and overheating of the barrel of the weapon upon firing of the projectile through the barrel. Advantageously, the above process minimizes the formation of sand and ash at the end of the barrel upon shooting of the ammunition which protects the environment and enhances the safety of surrounding personnel.

EXAMPLE 1

A ballistic lubricating grease was formulated with a polyalphaolefin base oil, a fumed silica thickener comprising amorphous silicon dioxide, and a disodium octaborate tetrahydrate additive. The polyalphaolefin oil was placed in a kettle and pot. Thereafter, the fumed silica and the disodium octaborate tetrahydrate additive were added to the kettle (pot) and thoroughly mixed with the polyalphaolefin base oil. The resultant mixture was milled in a colloid mill until a homogenous dispersion of the fumed silicia thickener and the disodium octaborate tetrahydrate additive were obtained throughout the grease. The ballistic lubricating grease had the following composition:

| Component | % (wt) |
|---|---|
| Polyalphaolefin Base Oil | 81.5 |
| Fumed Silica Thickener | 8.5 |
| Disodium Octaborate Tetrahydrate Additive | 10.0 |

The ballistic lubricating grease was tested and had the following performance properties:

| Test | Result |
|---|---|
| Unworked Penetration, ASTM D217 | 235 |
| Worked Penetration, ASTM D217 | 233 |
| Cone Leakage, Federal Test Method 321 for 24 hours at 125° F. | 0% (wt) |
| Base Oil Viscosity, ASTM D445 at 100° F. | 2131 SUS |
| Base Oil Viscosity, ASTM D445 at 210° F. | 188 SUS |
| Pour Point, ASTM D97 | −30° F. |
| Flash Point, ASTM D92 | 550° F. |

EXAMPLE 2

A ballistic lubricating grease was prepared in a manner similar to Example 1. The ballistic lubricating grease had the following composition:

| Component | % (wt) |
|---|---|
| Polyalphaolefin Base Oil | 79.17 |
| Fumed Silica Thickener | 10.8 |
| Disodium Octaborate Tetrahydrate Additive | 10.0 |

The ballistic lubricating grease was tested and had the following perfomance properties:

| Test | Result |
|---|---|
| Unworked Penetration, ASTM D217 | 255 |
| Worked Penetration, ASTM D217 | 285 |
| Cone Leakage, Federal Test Method 321 | |

-continued

| Test | Result |
|---|---|
| for 24 hours at 125° F. | 0% (wt) |
| Base Oil Viscosity, ASTM D445 at 100° F. | 2131 SUS |
| Base Oil Viscosity, ASTM D445 at 210° F. | 188 SUS |
| Pour Point, ASTM D97 | −30° F. |
| Flash Point, ASTM D92 | 550° F. |

Among the many advantages of the novel ballistic lubricating grease, ammunition, and process are:

1. Increased weapon effectiveness
2. Improved structural integrity of the weapon
3. Extends the useful life of the weapon
4. Causes less pollution
5. Protects the environment
6. Excellent oil separation qualities
7. Good oil bleeding protection to prevent the oil from contacting the propellant
8. Superior wear qualities
9. Reduced bore corrosion
10. Minimizes misfiring of ammunition
11. Increases the accuracy of the weapon
12. Good storage, firing, and flight stability
13. Superior cooling of the barrel
14. Prevents the barrel from overheating
15. Protection against propellant corrosive gases
16. Good flow characteristics
17. Effective in summer and winter
18. Efficient
19. Reliable
20. Economical
21. Nontoxic
22. Safe Although embodiments of this invention have been shown and described, it is to be understood that various modifications and substitutions, as well as rearrangements of structural elements, parts, and/or process steps, can be made by those skilled in the art without departing from the novel spirit and scope of this invention.

What is claimed is:

1. A ballistic lubricating process for extending the life of a barrel of a weapon, comprising the steps of:

shooting a projectile from a shell through a barrel of a weapon with a propellant by igniting and exploding said propellant;

said propellant emitting corrosive gases during said shooting;

expelling a borated lubricating grease from said projectile during said shooting;

borating said barrel of said weapon by substantially coating said barrel with said borated lubricating grease before a substantial amount of said corrosive gases can contact said barrel; wherein said borated lubricating grease comprises from about 60% to about 85% by weight base oil, from about 3% to about 20% by weight thickener, and from about 1% to about 20% by weight borate.

2. A ballistic lubricating process in accordance with claim 1 wherein said lubricating grease comprises by weight:

at least 75% base oil comprising polyalphaolefin;

less than about 12% thickener comprising amorphous silicon dioxide;

said amorphous silicon dioxide reacting with said polyalphaolefin to substantially minimize emissions of ash from said barrel of the weapon during said shooting; and less than about 12% borate comprising disodium octaborate tetrahydrate for cooling and substantially preventing the barrel of said weapon from overheating.

* * * * *

UNITED STATES PATENT OFFICE

CERTIFICATE OF CORRECTION

Patent No. 4,858,534 Dated August 22, 1989

Inventor(s) William G. Wallace

It is certified that error appears in the above-identified patent and that said Letters Patent is hereby corrected as shown below:

| Col. | Line | |
|---|---|---|
| 1 | 24 | "dgree" should read --degree-- |
| 1 | 59 | "deflect With" should read --deflect. With-- |
| 2 | 26 | "499,487,587,342," should read --499,487, 587,342,-- |
| 2 | 34 | "454,175," should read --4,454,175,-- |
| 2 | 63 | "protectinn" should read --protection-- |
| 4 | 12 | "is cross-sectional" should read --is a cross-sectional-- |
| 4 | 22 | "perrormance" should read --performance-- |
| 4 | 39 | "corrosion It" should read --corrosion. It-- |
| 4 | 53 | "ad" should read --and-- |
| 4 | 57 | "oontaining" should read --containing-- |
| 4 | 66 | "-hyde amine" should read -- -hyde-amine-- |
| 5 | 21-22 | "combination" should read --combinations-- |
| 6 | 21 | "1450,a" should read --1450, a-- |
| 6 | 24 | "THICKENER The thickener" should read --THICKENER (centered) (new para.) The thickener-- |

UNITED STATES PATENT OFFICE

CERTIFICATE OF CORRECTION

Patent No. 4,858,534 Dated August 22, 1989

Inventor(s) William G. Wallace

It is certified that error appears in the above-identified patent and that said Letters Patent is hereby corrected as shown below:

| Col. | Line | |
|---|---|---|
| 6 | 51 | "hydrolysis sili-" should read --hydrolysis of sili- -- |
| 7 | 21 | "octaborat" should read --octoborate-- |
| 10 | 22 | "lncreases" should read --Increases |

Signed and Sealed this

Second Day of February, 1993

*Attest:*

STEPHEN G. KUNIN

*Attesting Officer*

*Acting Commissioner of Patents and Trademarks*